United States Patent [19]

Castonguay et al.

[11] Patent Number: 4,913,503

[45] Date of Patent: Apr. 3, 1990

[54] MOLDED CASE CIRCUIT BREAKER ACTUATOR-ACCESSORY UNIT RESET MECHANISM

[75] Inventors: Roger N. Castonguay, Terryville; Joseph G. Nagy, Plainville; Richard E. Bernier, Southington; Ronald D. Ciarcia, Bristol; Keith W. Klein, Simsbury, all of Conn.

[73] Assignee: General Electric Company, New York, N.Y.

[21] Appl. No.: 254,754

[22] Filed: Oct. 7, 1988

[51] Int. Cl.[4] ..... H01H 9/00

[52] U.S. Cl. ..... 335/172; 335/174; 335/169

[58] Field of Search ..... 335/167-174, 335/6-10, 33

[56] References Cited

U.S. PATENT DOCUMENTS

| | | | |
|---|---|---|---|
| 4,641,117 | 2/1987 | Willard | 335/7 |
| 4,679,019 | 7/1987 | Todaro et al. | 335/172 |
| 4,700,161 | 10/1987 | Todaro et al. | 335/172 |
| 4,728,914 | 3/1988 | Morris et al. | 335/6 |
| 4,733,211 | 3/1988 | Castonguay et al. | 335/192 |
| 4,736,174 | 4/1988 | Castonguay et al. | 335/167 |
| 4,825,183 | 4/1989 | Hauschildt | 335/167 |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

An integrated protection unit is a circuit breaker which includes basic overcurrent protection facility along with selective electrical accessories. A molded plastic accessory access cover secured to the integrated protection unit cover protects the accessory components contained within the integrated protection unit cover from the environment. A combined overcurrent trip actuator and multiple accessory unit can be field-installed within the integrated protection unit. The combined actuator-accessory unit includes electronic control circuitry for the accessories along with mechanical trip and reset interface components. The reset mechanism allows the actuator-accessory unit to become reset without interferring with the operation of the integrated protection unit.

10 Claims, 11 Drawing Sheets

"TRIPPED"

MOLDED CASE CIRCUIT BREAKER ACTUATOR-ACCESSORY UNIT RESET MECHANISM

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the past, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker interior. U.S. patent application Ser. No. 240,885 describes a molded case circuit breaker containing an actuator-accessory unit which provides a wide variety of circuit protection accessory options. This Application is incorporated herein for purposes of reference and should be reviewed for its description of the state-of-the-art of such circuit breakers and accessory devices.

SUMMARY OF THE INVENTION

An integrated protection unit which includes overcurrent protection along with auxiliary accessory function within a common enclosure contains an accessory cover for access to the selected accessory components to allow field installation of the accessory components. A combined actuator-accessory unit provides overcurrent, shunt trip or undervoltage release functions and is arranged within one part of the enclosure. The printed wire board containing the accessory control circuit is arranged within the same part of the enclosure. An additional latch return spring allows the trip actuator to be operated in any position without nuisance tripping the associated circuit interrupter. An additional drive lever interconnects between the circuit interruption operating mechanism and the actuator-accessory unit to insure overcurrent and undervoltage protection during the reset operation of the actuator-accessory unit.

DESCRIPTION OF THE PREFERRED EMBODIMENT

Figure 1:
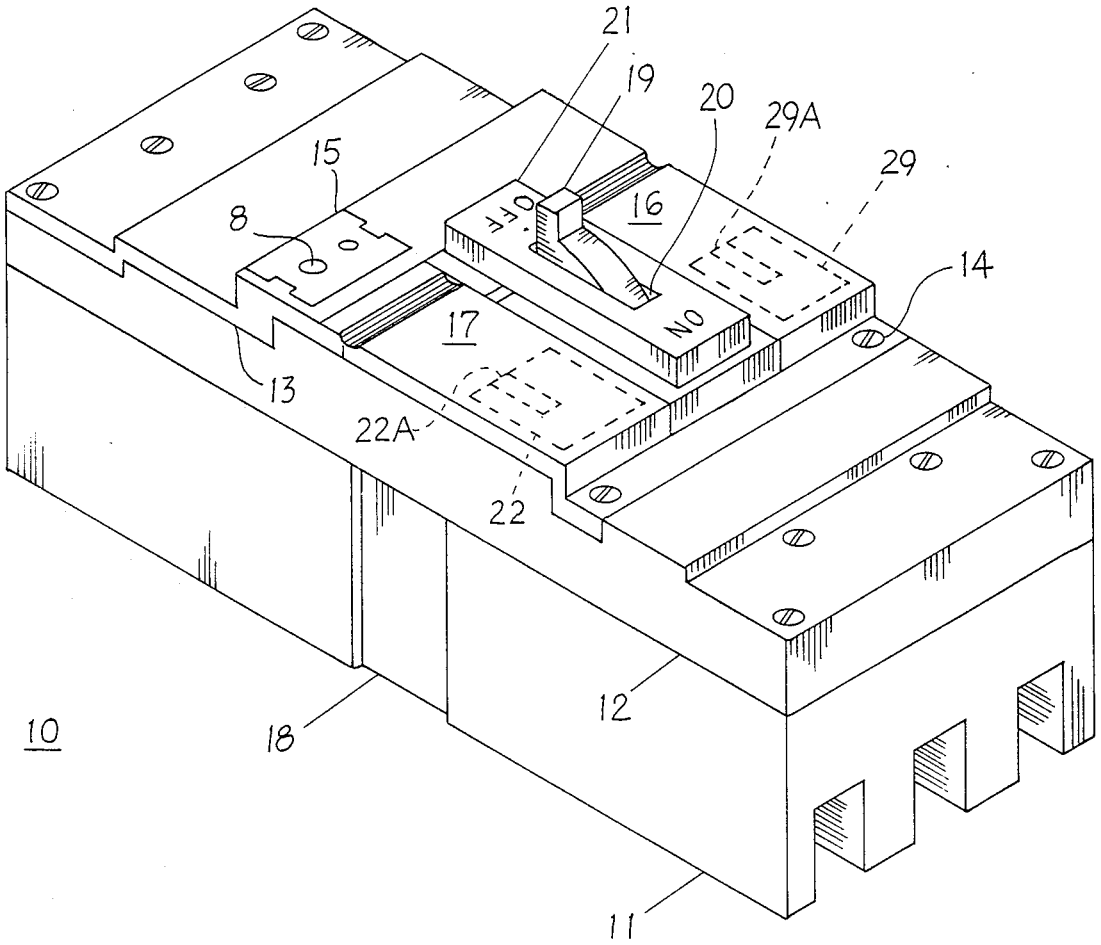
FIG. 1 is a top perspective view of an integrated molded case circuit breaker containing selected accessory functions.

An integrated circuit breaker 10 consisting of a molded plastic case 11 with a molded plastic cover 12 is shown in FIG. 1 with the accessory cover 13 attached to the circuit breaker cover by means of screws 14. The case includes a wiring slot 18 formed therein for allowing external connection with a remote switch or alarm. The circuit breaker operating handle 19 extends up from an access slot 20 formed in the cover escutcheon 21. A rating plug 15 such as described in U.S. Pat. No. 4,728,914 entitled "Rating Plug Enclosure for Molded Case Circuit Breakers", which Patent is incorporated herein for reference purposes, is shown assembled within the accessory cover. A pair of accessory doors 16, 17 are formed in the accessory cover for providing access to the combined electromagnetic actuator and multiple accessory unit 29, hereafter "actuator-accessory unit" and the auxiliary switch 22 shown behind the accessory doors. Access tabs 22A and 29A are shown on the top surface of the auxiliary switch 22 and the actuator-accessory unit 29 for purposes to be described below in greater detail.

Figure 2:
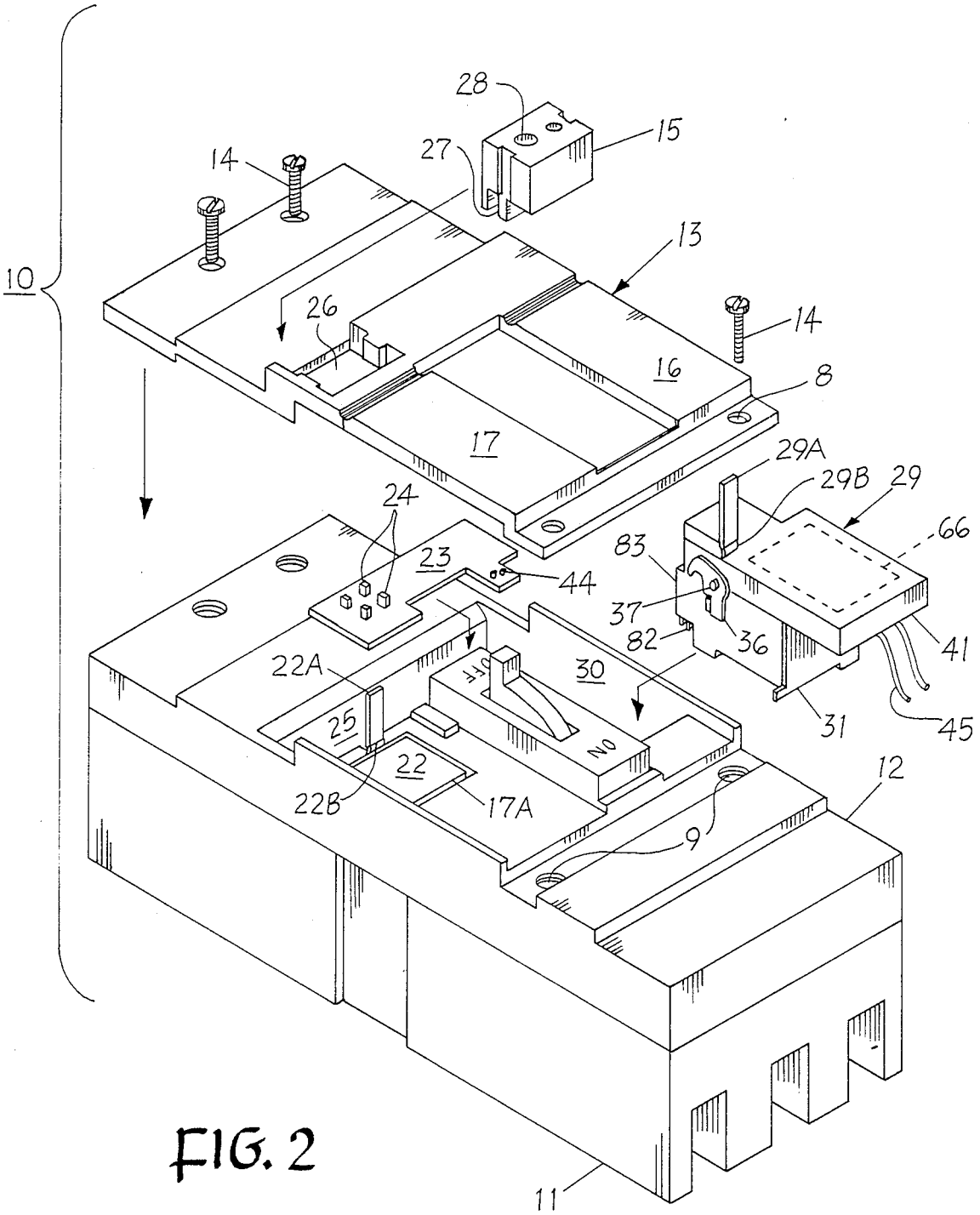
FIG. 2 is an exploded top perspective view of the integrated circuit breaker of FIG. 1 prior to assembly of the combined actuator-accessory unit according to the invention.
Figure 3:
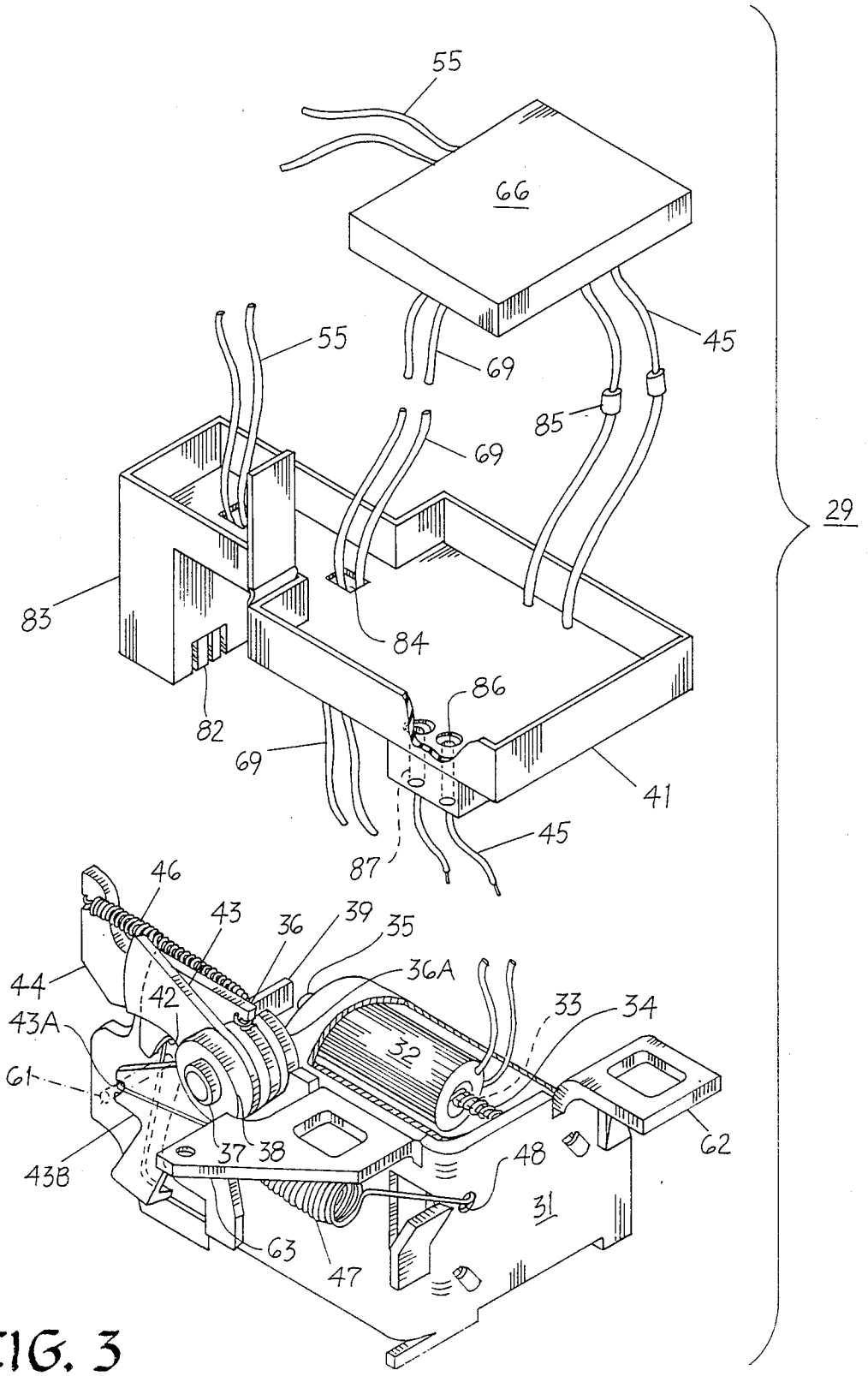
FIG. 3 is a top perspective view of the mechanical actuator assembly and magnetic latch arrangement of the actuator-accessory according to the invention.
Figure 4:
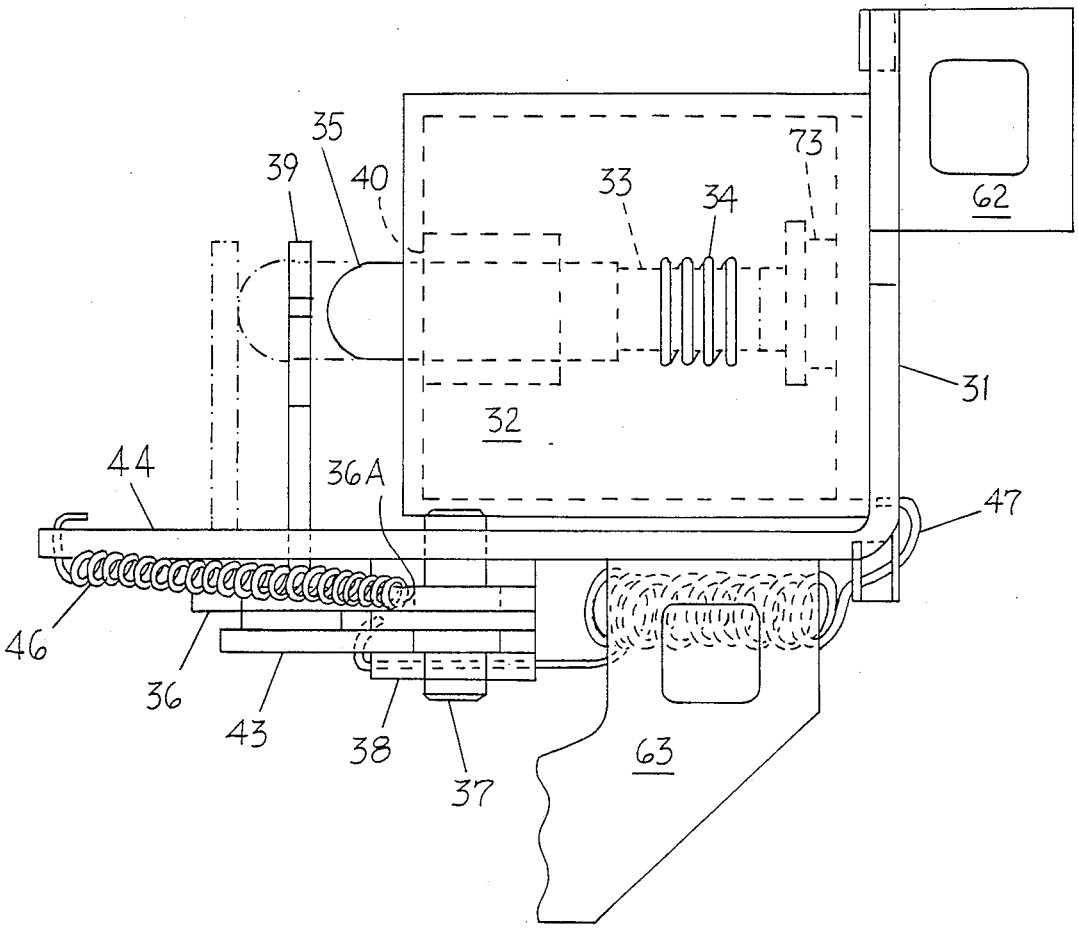
FIG. 4 is a top view of the mechanical actuator assembly and magnetic latch arrangement of the actuator-accessory of FIG. 3.
Figure 5:
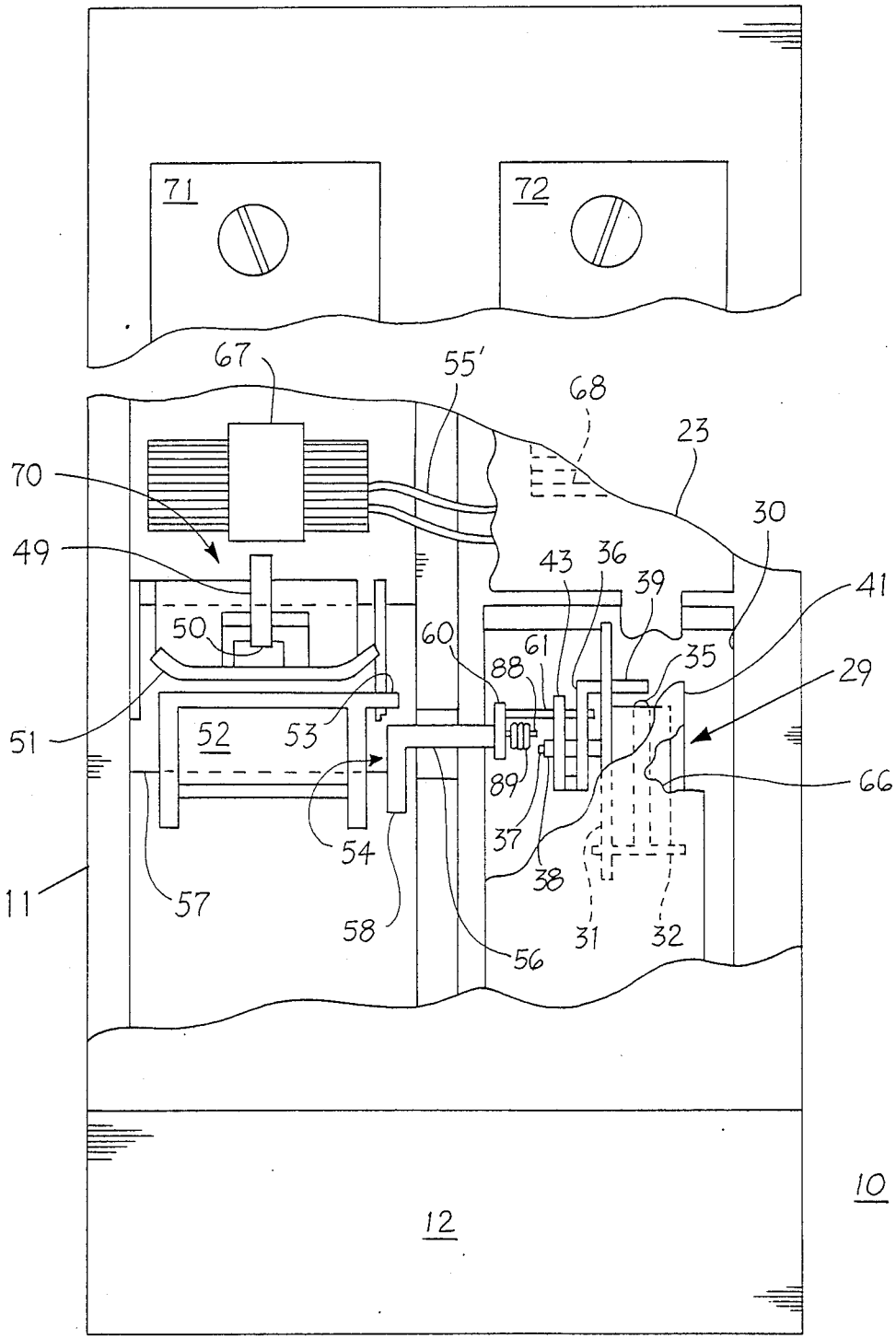
FIG. 5 is a plan view of the integrated molded case circuit with part of the cover removed to show the circuit breaker operating mechanism and combined actuator-accessory unit.

The rating plug 15 is fitted within a recess formed in the accessory cover 13 and the accessory cover is fastened to the circuit breaker cover by means of screws 14, thru-holes 8 and threaded openings 9 as shown in FIG. 2. Access to the rating plug interior for calibration purposes is made by means of the rating plug access hole 28. The trip unit for the integrated circuit breaker 10 is contained within a printed wire board 23 which is positioned in the trip unit recess 25. The rating plug 15 when inserted within the rating plug recess 26 interconnects with the printed wire board by means of pins 24 upstanding from the printed wire board and sockets 27 formed on the bottom of the rating plug. The pins 44 upstanding from the printed wire board connect with the electrical connector 82 provided on the bottom of extension 83 formed on the plastic top piece 41 which is attached to the actuator-accessory unit 29. The auxiliary switch 22 is positioned within the auxiliary switch recess 17A and is similar to that described in aforementioned U.S. patent application Ser. No. 133,868 filed Dec. 16, 1987 entitled "Molded Case Circuit Breaker Auxiliary Switch Unit". When the auxiliary switch and trip unit printed wire board have been assembled within their appropriate recesses, the actuator-accessory unit 29 is then installed within the actuator-accessory unit recess 30. When the actuator-accessory unit 29 and the auxiliary switch 22 are positioned within the circuit interrupter cover 12 and the accessory cover is closed, the upstanding access tabs 29A, 22A formed thereon become folded over their respective reduced thickness regions 29B, 22B and assume the positions indicated earlier with respect to FIG. 1. When the accessory cover is opened, the access tabs return to their upright positions to allow an operator to grasp the tabs and remove the respective actuator-accessory unit and auxiliary switch from the circuit interrupter cover. As shown in FIGS. 2, 3 and 4, the actuator-accessory unit is enclosed within a metallic housing 31 through which the trip actuator latch 36 and armature reset lever 43, hereafter "reset lever", extend and within which the actuator-accessory coil 32 is enclosed. The reset spring 47 and the take-up spring 46 shown in FIGS. 3 and 4 are not shown on the actuator-accessory unit 29 of FIG. 2 for purposes of clarity. The housing also contains an armature 33 and armature spring 34 which projects the armature extension 35 in a forward trip position against the holding force provided by the energized actuator-accessory coil 32. The plastic top piece 41 contains the printed wire board 66 which controls the operation of the actuator-accessory coil to which it is connected by conductors 69 which pass through an opening 84 formed in the bottom of the top piece. The printed wire board connects with the electrical conductors 55 as indicated, and with an external control circuit over conductors 45. The conductors 45 are fitted with wire retainer metallic sleeves 85 which sit in openings 86 formed in the bottom of the plastic top piece while the conductors 45 pass through smaller openings 87 formed thereunder. The metallic sleeves provide strain relief to the conductors and prevent the conductors from being pulled away from the printed wire board 66 when external force is applied. The actuator-accessory unit 29 is depicted in FIGS. 3, 4 and 5 with the printed wire board outside of the plastic top piece and with the top of the housing partially removed to show the interaction between the actuator-accessory coil 32 and the trip actuator latch 36. The armature extension 35 projects through a slot 40 formed in the housing in proximity to a trip actuator arm 39 at one end of the trip actuator latch 36. The trip actuator latch is pivotally attached to the housing 31 by means of a pivot pin 37 and by means of spacer-washers 38. A hook 42 formed at one end of the trip actuator latch cooperates with the circuit breaker operating mechanism shown in aforementioned U.S. Pat. No. 4,700,161 and U.S. patent application Ser. No. 163,589 in the manner to be described below in greater detail. The operation of the actuator-accessory unit 29 is similar to that described within U.S. Pat. Nos. 4,641,117 and 4,679,019 which Patents are incorporated herein for purposes of reference. The pair of wire conductors 45, as described earlier, connect the actuator-accessory unit with a remote switch or voltage source when undervoltage protection or shunt trip facility is desired.

The actuator-accessory unit 29 differs from that described within aforementioned U.S. patent application Ser. No. 163,589 by providing the reset lever 43 outboard the trip actuator latch 36 on the common pivot pin 37. The earlier actuator-accessory unit required complex additional components to compensate for the additional motion developed during the reset of the armature. The instant invention provides armature reset means which are less complex and more suited to high speed manufacture by not requiring compensation for any additional motion during reset of the armature. The reset lever of the instant invention for resetting the armature 33 is sandwiched between a pair of spacer-washers 38 similar to the trip actuator latch 36. The reset lever is biased by means of a powerful reset spring 47 attached between an opening 48 in the support 31 and a slot 43A formed on a projection 43B of the reset lever. The trip actuator latch 36 is biased by means of a lighter take-up spring 46 attached to a slot on the housing and to a slot 36A on the end of the trip actuator latch opposite the hook 42. The platforms 62, 63 formed on the top of the housing 31 support the plastic top piece 41 when the printed wire board 66 is inserted therein.

Before describing the detailed interaction between the trip actuator latch 36 and the reset lever 43, it is helpful to review the interaction between the trip actuator latch and the circuit breaker operating mechanism 70 in the integrated circuit breaker 10 as best seen by referring now to FIGS. 3, 4 and 5.

The actuator-accessory unit 29 is depicted in FIG. 5 within the recess 30 in the integrated circuit breaker 10 with part of the trip unit printed wire board 23, actuator-accessory unit printed wire board 66 and cover 12 removed to show the interaction between the actuator-accessory unit and the mechanical actuator assembly 54 which sits in the integrated circuit breaker cover 12. The circuit breaker operating mechanism shown generally at 70 includes a cradle operator 49 having a hook 50 formed at one end thereof which is retained by means of a primary latch 51 and which interacts with the operating mechanism crossbar depicted generally at 57. The secondary latch assembly 52 prevents the primary latch 51 from releasing the operating cradle 49 until the secondary latch is displaced by contact with a tab 53 extending from the secondary latch. Electric current flow is sensed by a pair of current transformers 67, 68 which are located ahead of load lugs 71, 72. The current transformers connect with the trip unit printed wire board 23 by means of conductors 55'. The operating lever 58 sits within the case 11 and connects with the latch support arm 60 in the recess 30 by means of connecting arm 56. The latch pin 61 is retained by the trip actuator latch 36 which is in turn controlled by the position of the trip actuator arm 39 which extends through the actuator-accessory housing 31. The trip actuator arm 39 interfaces with the armature extension 35 in the following manner. When the circuit current exceeds a predetermined value, a current pulse is applied to the actuator-accessory coil 32 to oppose the holding force provided by the permanent magnet 73 thereby allowing the armature extension 35 to be propelled by the urgency of the armature spring and to thereby rotate the trip actuator latch 36 in the clockwise direction about pivot pin 37 and to release the hook 42 from the latch pin 61. The rotation of the trip actuator latch 36 allows the latch support arm 60 to rotate in the counterclockwise direction under the urgence of a powerful trip spring 89 arranged around the latch support arm pivot 88. The rotation of the latch support arm 60 in the counterclockwise direction drives the operating lever 58 into contact with the tab 53 thereby articulating the circuit breaker operating mechanism 70 to separate the circuit breaker contacts (not shown).

Figure 6:
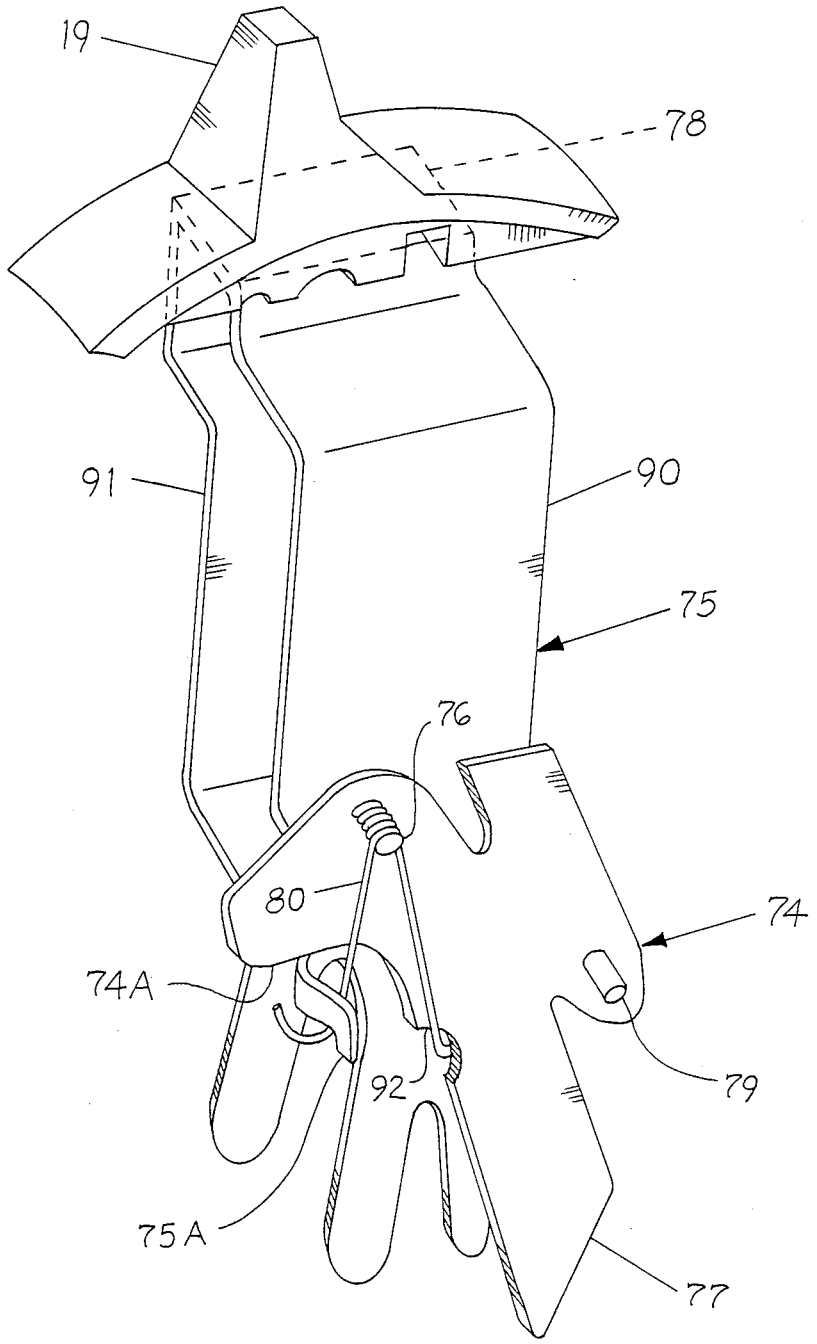
FIG. 6 is a side perspective view of the handle yoke within the circuit breaker of FIG. 1 containing a drive lever in accordance with the invention.
Figure 7:
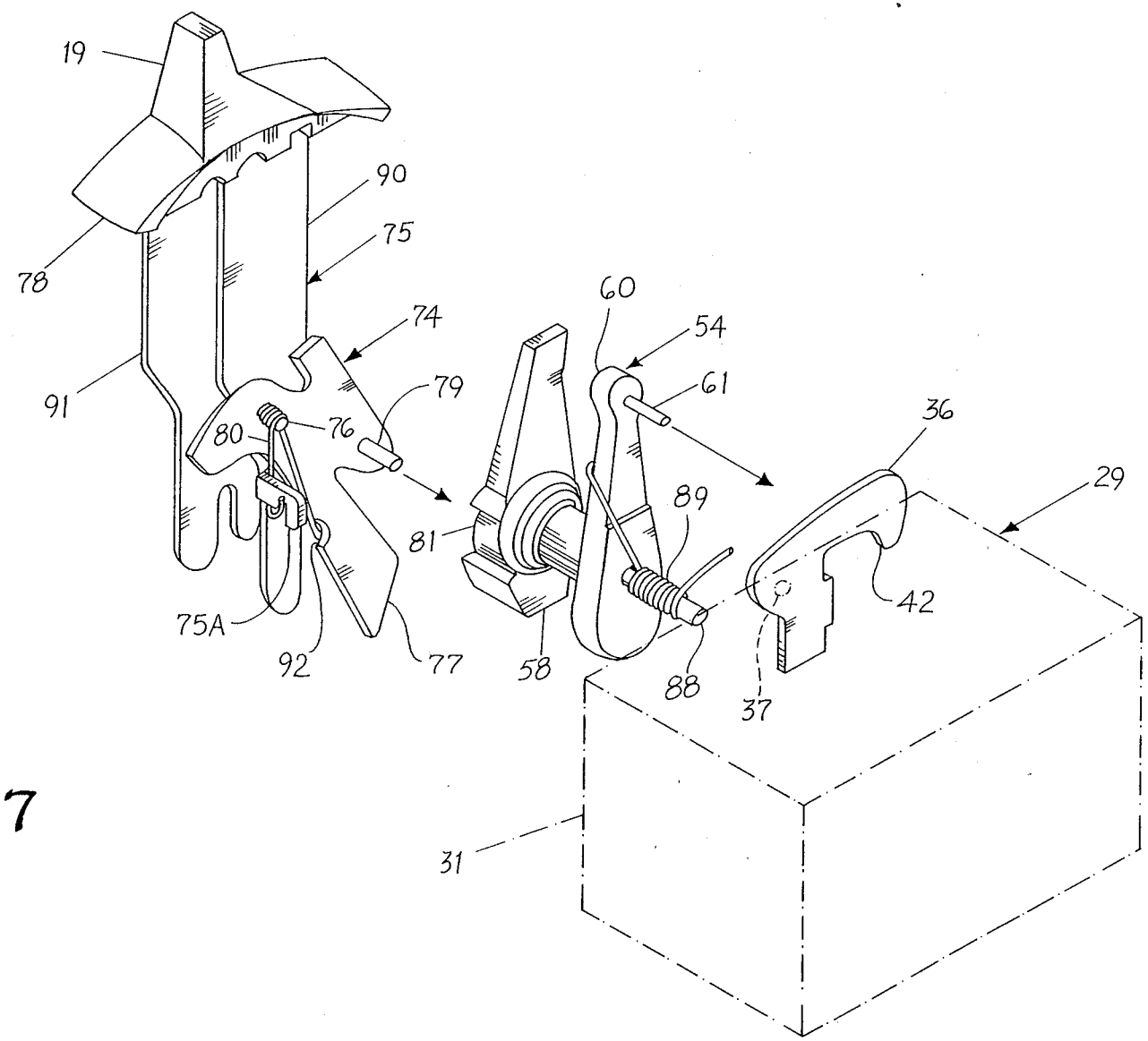
FIG. 7 is a front perspective view of the handle yoke of FIG. 6 with the actuator-accessory unit in isometric projection.

In accordance with the invention, the operating handle yoke 75 within the circuit breaker 10 of FIG. 1 is shown in FIG. 6 to consist of a pair of side pieces 90, 91 joined by a cross piece 78 to which the operating handle 19 is attached. A good description of the interaction between the handle yoke and the circuit breaker operating mechanism 70 shown in FIG. 5 is found within U.S. Pat. No. 4,736,174 entitled "Molded Case Circuit Breaker Operating Mechanism" which Patent is incorporated herein for reference purposes. A drive lever 74, having an extension 77 at the bottom and a contact surface 74A near the top, is pivotally attached to yoke side piece 90 by means of a pivot 76 around which a torsion spring 80 is arranged. The torsion spring extends between a slot 92 formed on the drive lever and a tab 75A formed on the side piece. A drive pin 79 extends from the drive lever out from the plane of the paper and interacts with the circuit breaker mechanical actuator assembly 54 and the actuator-accessory unit 29 as best seen by referring now to FIG. 7. The handle yoke 75 and drive lever 74 rotate the mechanical actuator assembly 54 by engagement of the drive pin 79 on the drive lever with the drive slot 81 formed within the operating lever 58. This in turn rotates the latch support arm 60 to trap the latch pin 61 under the hook 42 formed within the trip actuator latch 36 which is depicted as attached by means of pivot pin 37 to the actuator-accessory housing 31 shown in phantom. The mechanical actuator assembly 54 is then prevented from rotating in the opposite direction under the urgence of the powerful trip spring 89 on the latch support arm pivot 88 and the mechanical actuator assembly 54 is thereby reset. When the actuator-accessory unit is reset by capturing the latch pin 61 under hook 42, it is important that the actuator-accessory unit 29 and hence, the circuit breaker operating mechanism 70 described earlier, remain "trip-free". This means that the actuator-accessory unit should, at all times, be allowed to respond to an overcurrent condition to articulate the circuit breaker operating mechanism to separate the circuit breaker contacts or to respond to an undervoltage condition by preventing the circuit breaker contacts from becoming closed. In order to insure that the actuator-accessory unit remains trip-free after reset, the arrangement depicted in the following FIGS. 8A–8D is proposed.

Figure 8A:
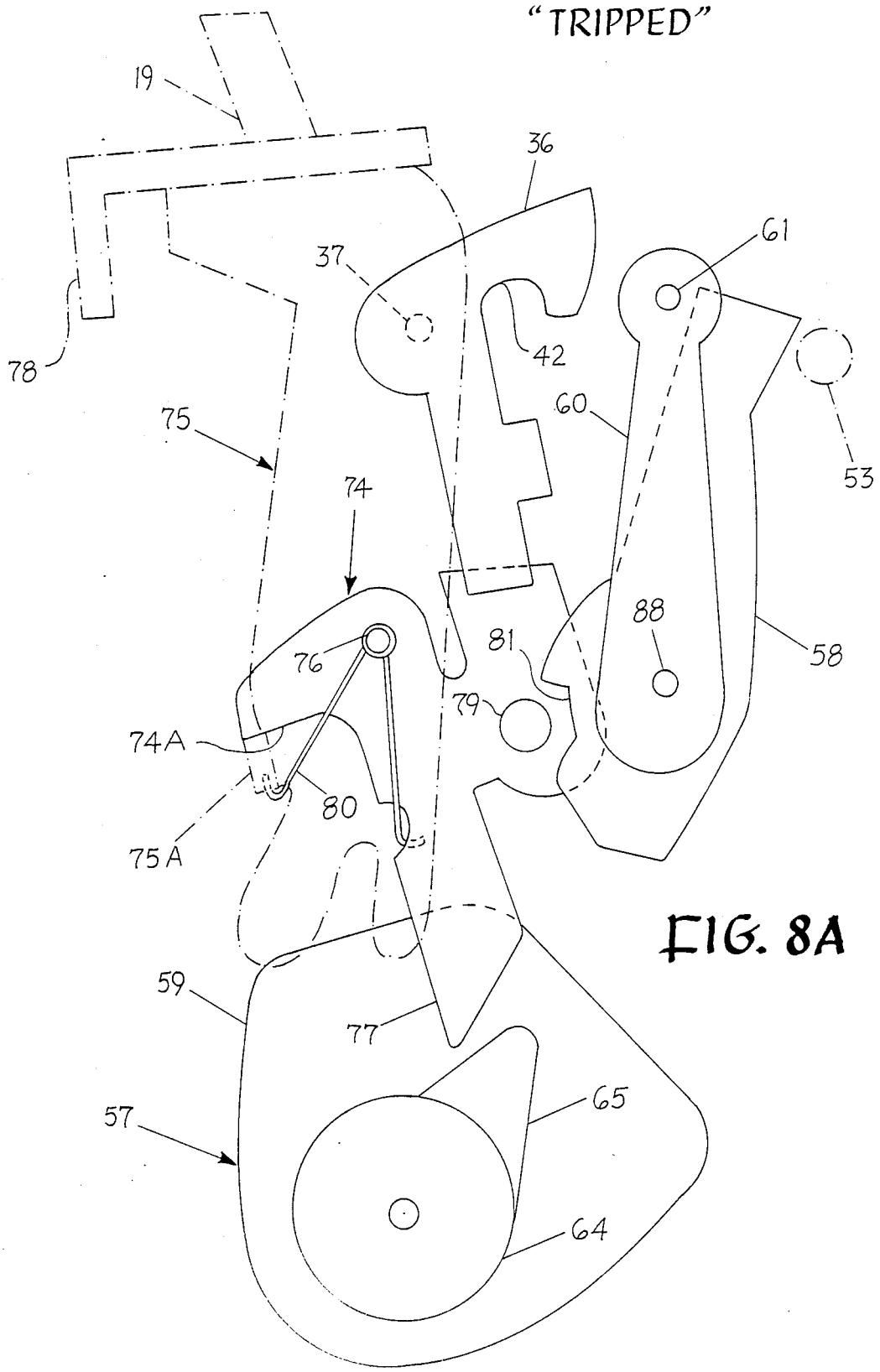
FIGS. 8A–8D are side views of the actuator-accessory of FIG. 3 the handle yoke and actuator-accessory unit of FIG. 7 interacting with the crossbar assembly within the circuit breaker of FIG. 6 in various latched and reset conditions.

The crossbar 57 is located within the circuit breaker case 11 shown in FIG. 1 and is described in U.S. Pat. No. 4,733,211 entitled "Molded Case Circuit Breaker Crossbar Assembly", which Application is incorporated herein for reference purposes. The crossbar which controls the "ON" and "OFF" condition of the circuit breaker contacts is integrally formed from a plastic composition which includes barriers 59 separating between the individual phases of a multipole circuit breaker and an integrally formed pivot post 64 which nestles within slots formed within the opposing sides of the circuit breaker case as described within the aforementioned U.S. Patent. The handle yoke 75, depicted in phantom, governs the "ON" and "OFF" conditions of the circuit breaker contacts by rotating the crossbar in either a clockwise direction to open the contacts or in a counterclockwise direction to close the contacts. The crossbar also becomes rotated to the clockwise direction upon the occurrence of an overcurrent condition whereby the circuit breaker operating mechanism becomes articulated in the manner described earlier. This tripped condition of the circuit breaker is depicted in FIG. 8A. It is noted that the latch pin 61 carried by the latch support arm 60 and attached to the operating lever 58 by means of the pin 88 is out from under the hook 42 formed on the trip actuator latch 36 which allows the operating lever to contact the tab 53, shown in phantom and which articulates the circuit breaker operating mechanism as described earlier. The trip actuator latch 36 is attached to the actuator-accessory unit housing 31 by means of the pivot pin 37 as described earlier with respect to FIG. 4. The drive lever 74 is attached to the handle yoke 75 by means of a pivot pin 76 and includes the forward surface 74A described earlier which interacts with a bent tab 75A on the handle yoke to assist in positioning the drive lever with respect to the crossbar 57 and with respect to the operating lever 58. The drive pin 79 protruding from the drive lever 74 in turn interacts with a drive slot 81 formed in the operating lever 58 opposite the latch support arm pivot pin 88 when the operating handle 19 is rotated from the tripped position indicated in FIG. 8A to the reset position indicated in FIG. 8B. The extension 77 on the bottom of the drive lever at this time is out of contact with the projection 65 formed on crossbar 57.

Figure 8B:
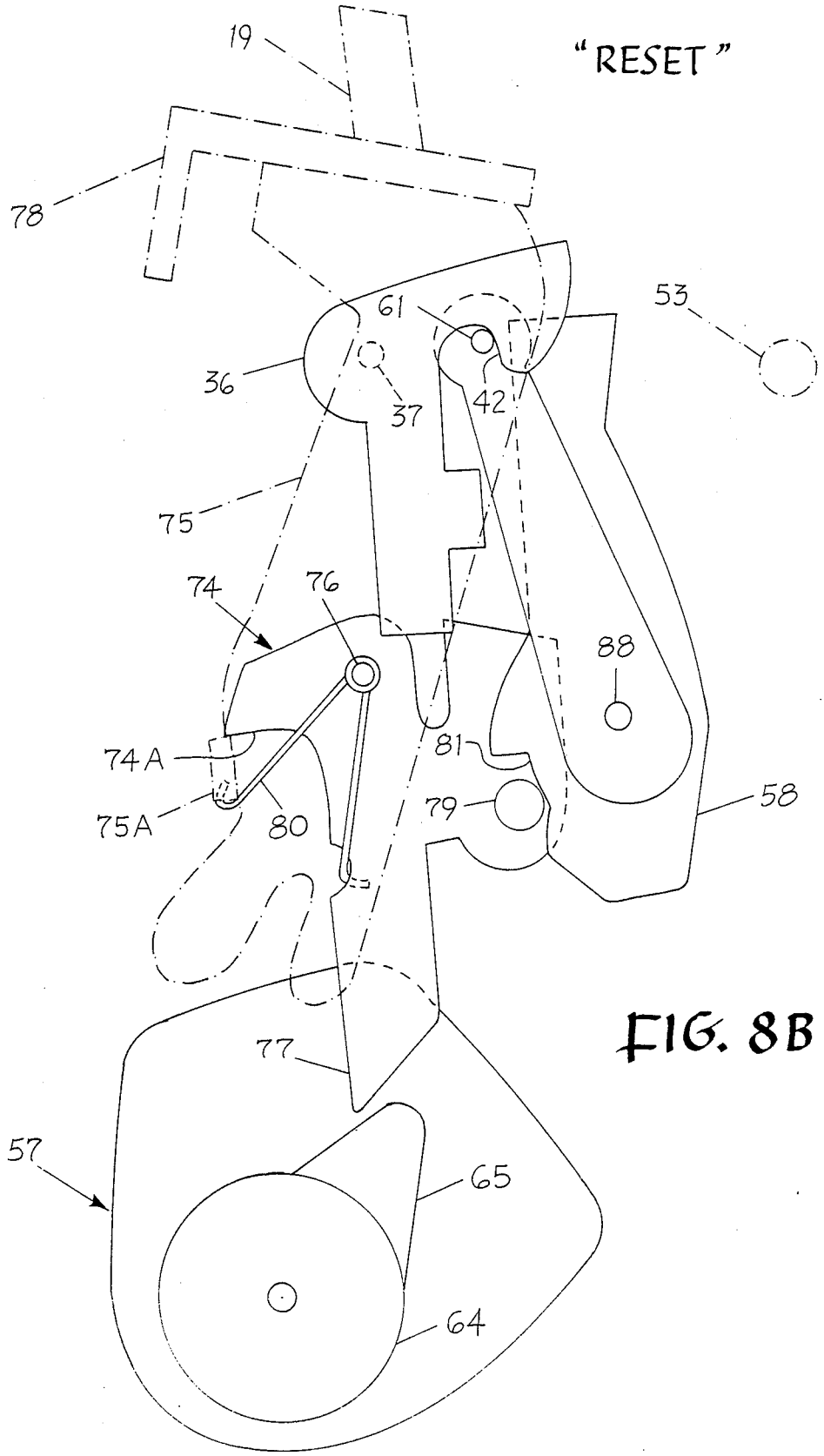
Figure 8C:
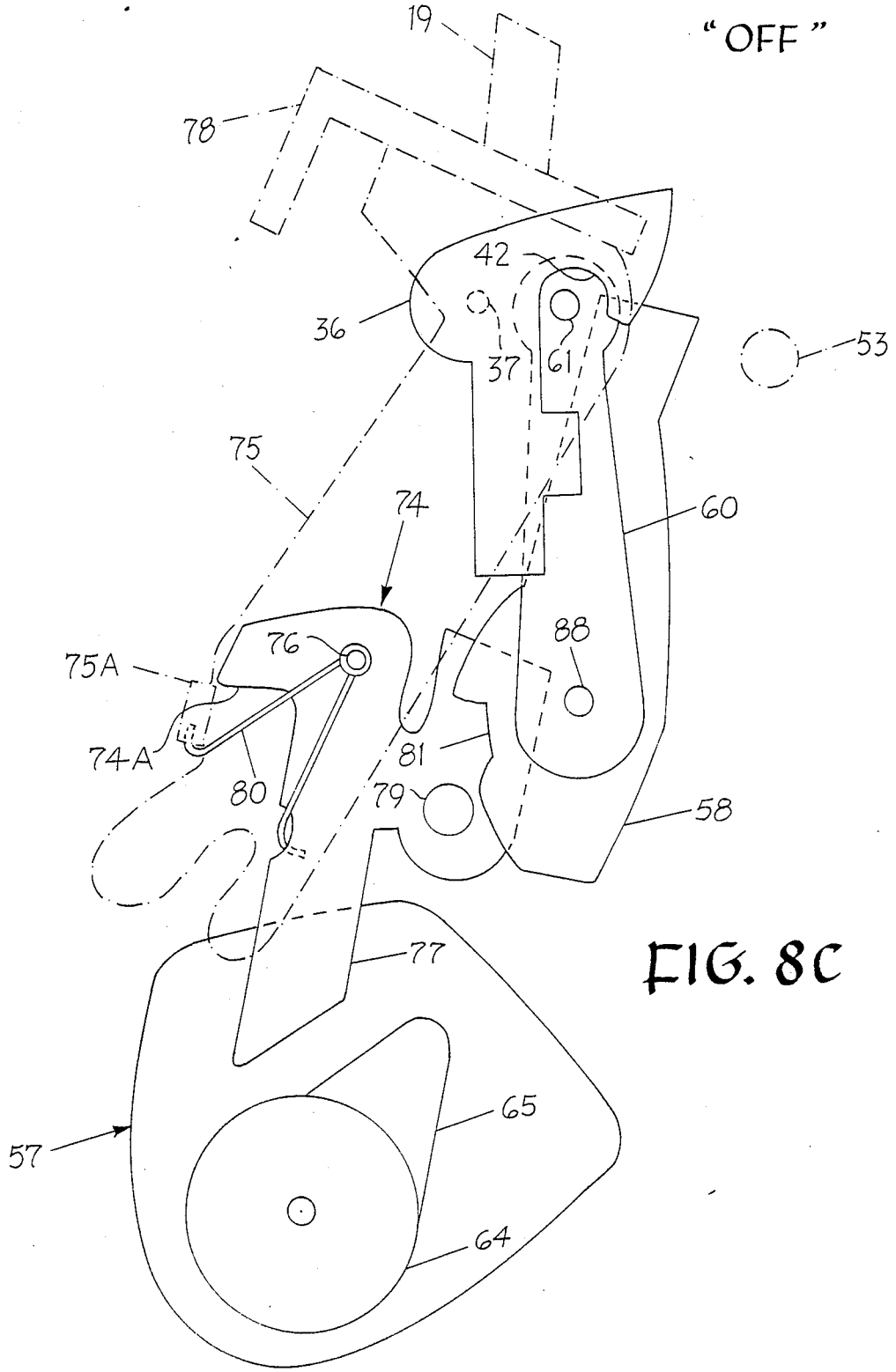
Figure 8D:
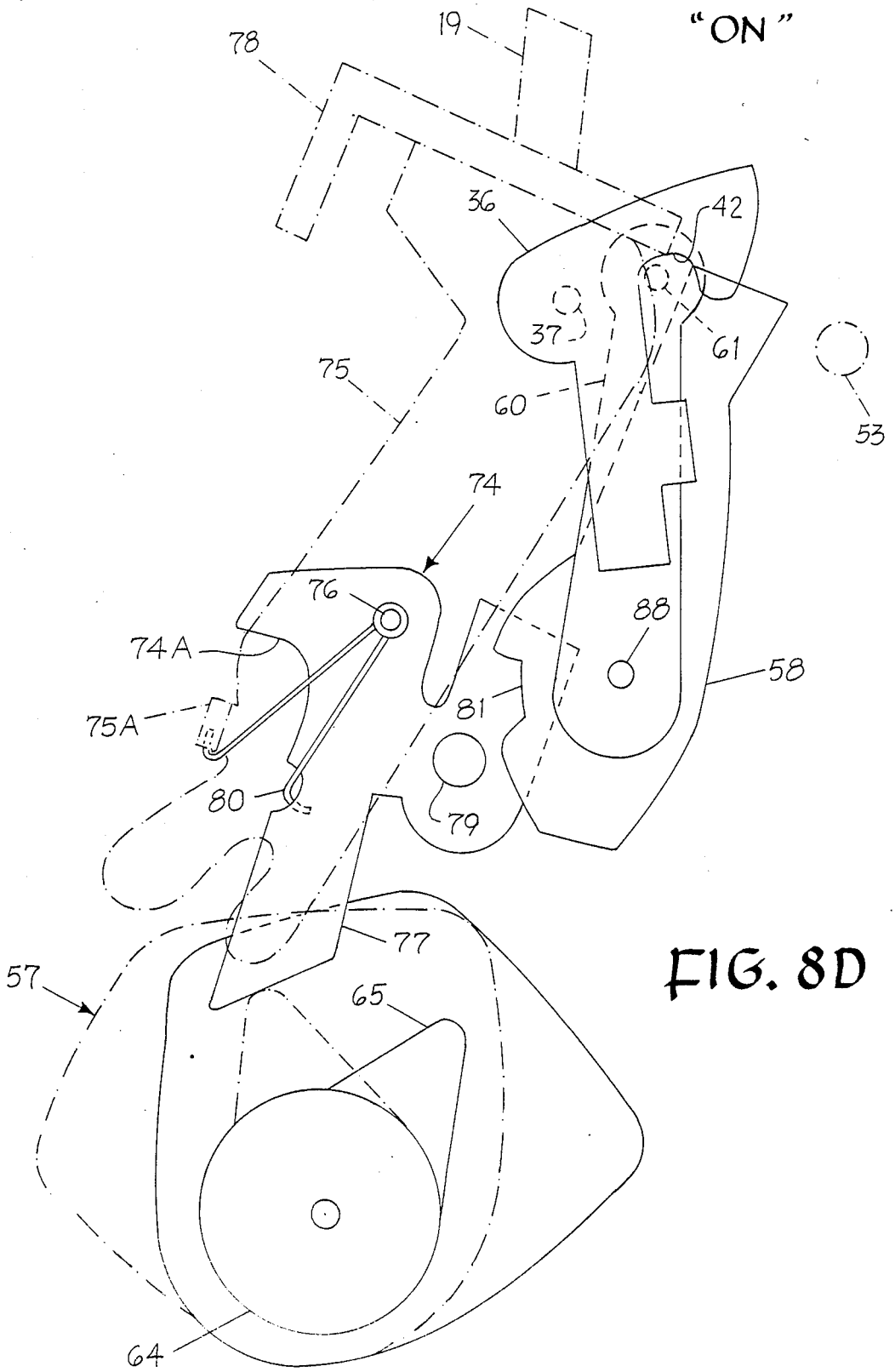

In order to reset the actuator-accessory unit, the operating handle 19 is rotated in the clockwise direction to engage the latch pin 61 under the hook 42 on the trip actuator latch 36 as shown in FIG. 8B. It is noted that the projection 65 remains to the right of the center line of the crossbar which indicates that the circuit breaker contacts are in their separated conditions and the circuit breaker is "OFF". Temporary connection between the handle yoke 75 and the operating lever 58 is made by means of the capturing of the drive pin 79 extending out from the page of the paper, within the drive slot 81 formed within the operating lever. It is noted that the engagement between the handle yoke and the operating lever by means of the drive lever allows both to move in unison as the operating handle 19 is rotated in the clockwise direction toward the tab 53 to engage the latch pin 61 with the trip actuator latch 36 to reset the actuator-accessory unit. As the circuit breaker handle 19 is rotated further in the "OFF" direction shown in FIG. 8C, the line of force F between the drive pin 79 and drive slot 81 coincide such that the drive pin 79 moves out from the drive slot 81 thereby disconnecting the operating lever 58 and latch support arm 60 from the driver lever 74. This by-pass arrangement is important when the circuit breaker contains an undervoltage release accessory and an undervoltage condition has occurred. The release of the latch pin 61 and subsequent articulation of the circuit breaker operating mechanism is not interfered with by the drive pin 79. It is a further important feature of this invention to prevent the circuit breaker contacts from being closed while such undervoltage condition continues to exist. The contacts are accordingly prevented from becoming closed by the disconnection between the drive pin 79 and drive slot 81 which effectively disengages operating handle 19 from the actuator accessory unit.

In order to reset the circuit breaker operating mechanism best seen by referring back to FIG. 5, the operating handle 19 is rotated further in the clockwise or "OFF" direction until the hook 50 on the cradle 49 engages the primary latch 51 which then allows the crossbar 57 to be fully rotated in the counterclockwise or "ON" direction, closing the circuit breaker contacts. As the operating handle 19 is now rotated in the counterclockwise or "ON" position indicated in FIG. 8D, the actuator-accessory unit remains latched whereby the latch pin 61 is retained under the hook 42. The drive pin 79 is beneath the drive slot 81 which accordingly insures that the actuator-accessory unit is in condition to release the operating lever 58 into contact with the tab 53 should an overcurrent or undervoltage condition occur when the crossbar 57 is further rotated counterclockwise to the fully "ON" position as indicated in phantom. During rotation in the clockwise direction, the projection 65 on the crossbar 57 strikes the extension 77 on the drive lever 74 driving the surface 74A on the drive lever 74 away from the tab 75A on the handle yoke 75 to completely disengage the drive pin 79 away from slot 81 on lever 58 when the crossbar 57 is rotated to the "ON" position.

It is noted, that the only time that the handle yoke 75 engages the operating lever 58 is when the circuit breaker contacts are in the open position. This is insured by the logic provided by the position of the crossbar 57 which controls the ON - OFF conditions of the circuit breaker contacts and the engagement between the projection 65 on the crossbar which insures complete disconnection between the drive pin 79 and the drive slot 81 when the contacts are closed.

Having thus described our invention, what we claim as new and desire to secure by Letters Patent is:

1. A molded case circuit breaker having a combined trip actuator and accessory unit comprising:

a molded case circuit breaker case and cover;

a circuit breaker operating mechanism within said case arranged for separating a pair of contacts to interrupt circuit current through said contacts;

a crossbar assembly connected with said operating mechanism, and one of said contacts, said crossbar assembly interfacing with an operating handle yoke for manual opening and closing of said contacts;

a trip actuator-accessory unit within a recess in said circuit breaker cover proximate said operating mechanism and including a trip actuator latch pivotally attached to a support housing for articulating said operating mechanism to separate said contacts automatically upon overcurrent conditions through said contacts;

an operating lever in said case proximate said operating mechanism and interfacing with said actuator-accessory unit through a latch support arm, said latch support arm including a latch pin being retained by said trip actuator latch in the absence of said overcurrent conditions through said contacts, said latch pin being released by said trip actuator latch upon occurrence of said overcurrent conditions;

an electromagnetic coil and a spring-biased plunger within said actuator-accessory unit, said plunger being restrained from moving said trip actuator latch away from said latch pin; and a drive lever attached to said operating handle yoke by means of a pivot pin and interacting with said operating lever to rotate said operating lever and said latch support arm to engage said latch pin with said trip actuator latch.

2. The molded case circuit breaker of claim 1 wherein said trip actuator-accessory unit includes a metal support housing, said trip actuator latch being pivotally supported on said housing by means of a pivot pin.

3. The molded case circuit breaker of claim 1 wherein said trip actuator latch includes a hook-shaped end for retaining said pin.

4. The molded case circuit breaker of claim 2 wherein said housing comprises a side wall, said electromagnetic coil and said plunger being mounted on one side of said side wall, said trip actuator latch being pivotally arranged on an opposite side of said side wall.

5. The molded case circuit breaker of claim 1 wherein said trip actuator-accessory unit includes an electronic circuit connected with said electromagnetic coil for controlling the position of said plunger.

6. The molded case circuit breaker of claim 5 wherein said electronic circuit is arranged within a plastic enclosure on a top surface of said recess, said plastic enclosure being attached to said support housing.

7. The molded case circuit breaker of claim 6 further including an accessory cover attached to said circuit breaker cover and arranged for covering said recess and said trip actuator-accessory unit therein.

8. The molded case circuit breaker of claim 1 wherein said drive lever includes a return spring arranged around said pivot pin and attached to said operating handle yoke at one end and to said drive lever at an opposite end.

9. The molded case circuit breaker of claim 8 wherein said operating handle yoke includes a tab extending into contact with a surface on said reset lever to cause said reset lever and said operating handle yoke to rotate in unison.

10. The molded case circuit breaker of claim 8 wherein said drive lever includes an extension and said crossbar assembly includes a projection whereby said projection strikes said extension and moves said drive lever out of contact with said operating lever to allow said handle yoke and said drive lever to rotate independently.

* * * * *